US011013313B2

(12) United States Patent
Xi et al.

(10) Patent No.: US 11,013,313 B2
(45) Date of Patent: May 25, 2021

(54) ORAL CARE IMPLEMENT

(71) Applicant: Colgate-Palmolive Company, New York, NY (US)

(72) Inventors: Wen Jin Xi, Shanghai (CN); Guang Sheng Guo, Yangzhou (CN); Felix Mueller, Zell am See (AT); Robert Moskovich, Manakin-Sabot, VA (US); Stephen Nelson, New Brunswick, NJ (US); Joachim Storz, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/722,618

(22) Filed: Dec. 20, 2019

(65) Prior Publication Data

US 2020/0121067 A1 Apr. 23, 2020

Related U.S. Application Data

(63) Continuation of application No. 15/113,390, filed as application No. PCT/CN2015/084889 on Jul. 23, 2015, now Pat. No. 10,561,229.

(51) Int. Cl.
*A46B 5/02* (2006.01)
*A46B 9/04* (2006.01)

(52) U.S. Cl.
CPC ..... *A46B 5/026* (2013.01); *A46B 5/02* (2013.01); *A46B 9/04* (2013.01); *A46B 2200/1066* (2013.01)

(58) Field of Classification Search
CPC ... A46B 2200/1066; A46B 5/02; A46B 5/026; A46B 9/04
See application file for complete search history.

(56) References Cited

U.S. PATENT DOCUMENTS

| | | | |
|---|---|---|---|
| 5,375,012 | A | 12/1994 | Borrelli et al. |
| 5,898,967 | A | 5/1999 | Wu et al. |
| 6,234,798 | B1 | 5/2001 | Beals et al. |
| 6,276,020 | B1 | 8/2001 | Leversby et al. |

(Continued)

FOREIGN PATENT DOCUMENTS

| | | |
|---|---|---|
| CN | 102651983 | 8/2012 |
| CN | 202959287 | 6/2013 |

(Continued)

OTHER PUBLICATIONS

CN-203220069-U—English Machine Translation (Year: 2013).*
CN 203220069 U—Oct. 2013—English Machine Translation.

*Primary Examiner* — Marc Carlson

(57) ABSTRACT

An oral care implement including an elongated body having a head portion supporting plurality of tooth cleaning elements and a handle portion defining an outer surface. A grip control component is disposed on the handle portion and includes a pair of transversely spaced apart control surfaces separated by a longitudinally extending channel. The control surfaces are elevated above the outer surface of the handle portion and positioned to engage a user's thumb. The control component is operable to tilt the head portion at an upward or downward angle relative to a vertical plane of a user's teeth when the control component is grasped between the user's thumb and forefinger for producing a proper brushing angle at the gum line.

18 Claims, 10 Drawing Sheets

(56) References Cited

U.S. PATENT DOCUMENTS

| | | | | |
|---|---|---|---|---|
| 6,353,958 | B2 | 3/2002 | Weihrauch | |
| 6,394,094 | B1 | 5/2002 | McKenna et al. | |
| 6,408,476 | B1 | 6/2002 | Cann | |
| 6,601,272 | B2 * | 8/2003 | Stvartak | A46B 5/02 132/200 |
| 6,668,416 | B1 | 12/2003 | Georgi et al. | |
| 6,687,940 | B1 | 2/2004 | Gross et al. | |
| 6,919,038 | B2 | 7/2005 | Meyer et al. | |
| 6,972,106 | B2 | 12/2005 | Huber et al. | |
| 7,047,591 | B2 * | 5/2006 | Hohlbein | A46B 5/028 15/143.1 |
| 7,083,756 | B2 | 8/2006 | Strahler | |
| 7,297,303 | B2 | 11/2007 | Kraemer | |
| 7,383,619 | B2 | 6/2008 | Gross et al. | |
| 7,415,788 | B2 | 8/2008 | Little et al. | |
| 7,458,125 | B2 * | 12/2008 | Hohlbein | A46B 17/08 15/143.1 |
| 7,691,309 | B2 | 4/2010 | Ebner et al. | |
| 7,921,499 | B2 | 4/2011 | Huber et al. | |
| D643,219 | S * | 8/2011 | Xi | D4/108 |
| 8,046,864 | B2 | 11/2011 | Baertschi et al. | |
| 8,060,972 | B2 | 11/2011 | Geiberger et al. | |
| 8,382,208 | B2 | 2/2013 | Baertschi et al. | |
| 8,549,691 | B2 | 10/2013 | Moskovich et al. | |
| 8,997,297 | B2 | 4/2015 | Mohr et al. | |
| 9,060,593 | B2 | 6/2015 | Ballmaier et al. | |
| 9,510,669 | B2 | 12/2016 | Newman et al. | |
| D777,446 | S * | 1/2017 | Xi | D4/104 |
| 9,539,750 | B2 | 1/2017 | Gross et al. | |
| D798,062 | S * | 9/2017 | Bauernfeind | D4/104 |
| 2002/0138931 | A1 * | 10/2002 | Davies | A46B 5/02 15/167.1 |
| 2003/0019063 | A1 | 1/2003 | Abraham | |
| 2003/0178745 | A1 | 9/2003 | Scarabelli et al. | |
| 2010/0101034 | A1 | 4/2010 | Huang | |
| 2010/0125962 | A1 | 5/2010 | Davies et al. | |
| 2011/0146015 | A1 * | 6/2011 | Moskovich | A61C 17/00 15/167.1 |
| 2014/0173853 | A1 * | 6/2014 | Kirchhofer | B29C 45/1642 16/430 |
| 2014/0291891 | A1 | 10/2014 | Charnay | |
| 2017/0150808 | A1 * | 6/2017 | Xi | A46B 5/026 |

FOREIGN PATENT DOCUMENTS

| | | | |
|---|---|---|---|
| CN | 203220069 | | 10/2013 |
| CN | 203220069 | U * | 10/2013 |
| DE | 19981058102 | | 6/2000 |
| DE | 102006005616 | | 8/2007 |
| EP | 0580406 | | 1/1994 |
| EP | 0668140 | | 8/1995 |
| EP | 0721832 | | 7/1996 |
| EP | 1194053 | | 4/2002 |
| EP | 1211962 | | 6/2002 |
| EP | 1559530 | | 8/2005 |
| EP | 1951084 | | 8/2008 |
| JP | 3162573 | | 5/2001 |
| JP | 2003-025376 | | 1/2003 |
| JP | 4159739 | | 10/2008 |
| JP | 4666587 | | 4/2011 |
| WO | 2002/078489 | | 10/2002 |
| WO | 2004/026162 | | 4/2004 |
| WO | 2004/043669 | | 5/2004 |
| WO | 2006/125597 | | 11/2006 |
| WO | 2007/053034 | | 5/2007 |
| WO | 2011/075133 | | 6/2011 |

* cited by examiner

ORAL CARE IMPLEMENT

CROSS-REFERENCE TO RELATED APPLICATIONS

The present application is a continuation of U.S. patent application Ser. No. 15/113,390, filed Jul. 21, 2016, which is a national stage entry under 35 U.S.C. § 371 of PCT/CN2015/084889, filed Jul. 23, 2015, the entireties of which are incorporated herein by reference.

BACKGROUND

It is desirable to orient the head of the toothbrush with tooth cleaning elements at about a 45 degree angle to the teeth and gums when brushing at the upper or lower gum lines. This positioning optimizes cleansing effectiveness at this interface which can harbor bacteria that cause tooth and gum related diseases. The proper positioning of the toothbrush has largely been left up to the user. Some users may find it difficult to properly angle the toothbrush head when brushing. A need therefore exists for an improved oral care implement which helps the user find and maintain the proper brushing angle of the toothbrush.

BRIEF SUMMARY

The present invention provides an oral care implement which can be in the form of a toothbrush which is designed to promote the foregoing proper brushing angle. In one implementation, the toothbrush includes a grip control component configured to automatically position the toothbrush head at the desired angle when the user grips the toothbrush handle.

In one embodiment, the invention can be an oral care implement comprising: an elongated body extending along a longitudinal axis and comprising a head portion and a handle portion having an outer surface; a plurality of tooth cleaning elements extending from a front surface of the head portion of the elongated body; and a grip control component disposed on the handle portion to form a control section of a handle of the oral care implement, the grip control component comprising a first control surface and a second control surface, the first and second control surfaces transversely spaced apart from one another and separated by a longitudinally extending channel, at least a portion of each of the first and second control surfaces being raised above the outer surface of the handle portion.

In another embodiment, the invention can be an oral care implement comprising: an elongated body extending along a longitudinal axis, the elongated body including a head portion and a handle portion comprising an outer surface, the elongated body formed of a rigid material; a plurality of tooth cleaning elements extending from a front surface of the head portion; first and second grip elements on the handle portion of the elongated body to form a control section of a handle of the oral care implement, the first and second grip elements transversely spaced apart from one another; and each of the first and second grip elements formed of a resilient material and protruding from the outer surface of the elongated body to form a longitudinally extending channel therebetween.

In another embodiment, the invention can be an oral care implement comprising: a longitudinal axis extending from a proximal end of the oral care implement to a distal end of the oral care implement; a head comprising the distal end; a plurality of tooth cleaning elements extending from a front surface of the head; a handle comprising the distal end, a control section, and a finger gripping section, the finger griping section extending from the proximal end to the control section; a first reference plane that includes the longitudinal axis and intersects the front surface of the head; and the control section comprising a transverse cross-sectional profile comprising a channel defined by a floor and opposing first and second sidewalls, the channel intersected by the first reference plane.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
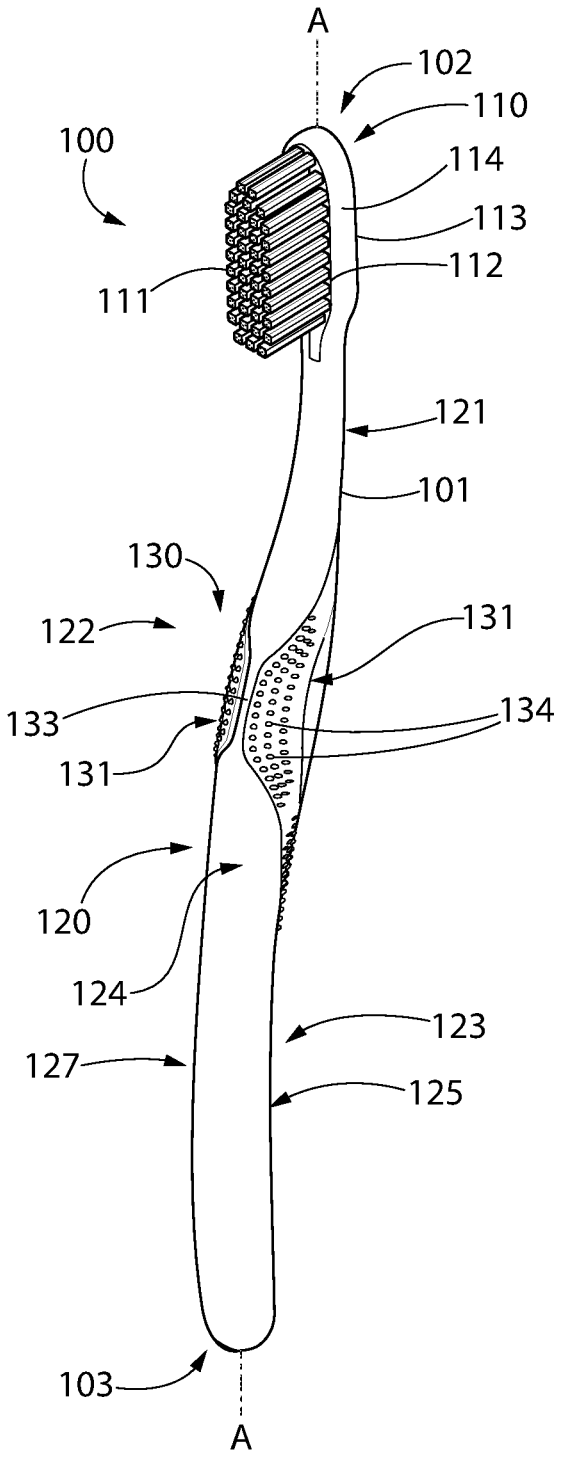
FIG. 1 is a front perspective view of an oral care implement according to one embodiment of the present invention.
Figure 2:
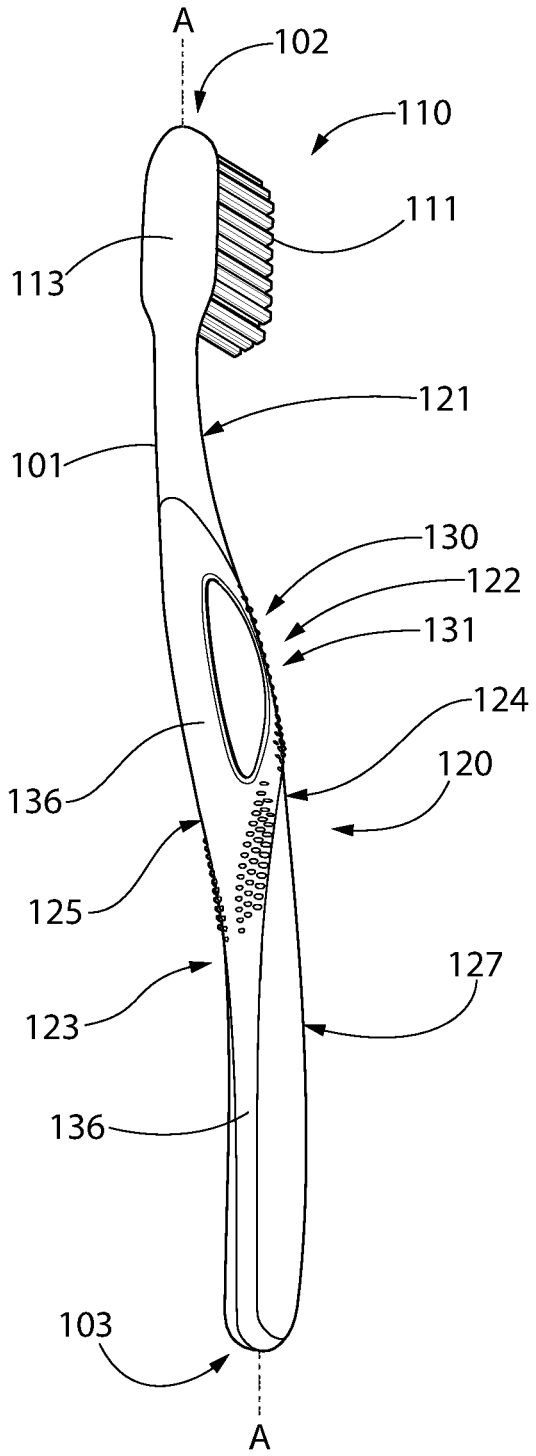
FIG. 2 is a rear perspective view thereof.

All drawing are schematic and not necessarily to scale.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Referring to FIGS. 1-9, a non-limiting embodiment of an oral care implement according to the present disclosure may be a toothbrush 100. Toothbrush 100 generally includes an elongated body 101 extending from a proximal end 103 to a distal end 102 along a longitudinal axis A-A. The body 101 includes a front side 112, opposing rear side 113, and opposing lateral sides 114 extending between the front and rear sides. A vertical plane drawn through the longitudinal axis A-A from the distal to proximal ends 102, 103 and normal to the front side 112 of the body divides the body 101 of the toothbrush 100 into a right side and left side as viewed from the front side of the body in FIG. 3.

The longitudinal axis A-A follows the contours and shapes of the toothbrush body 101 from proximal to distal ends 103, 102 and remains at the centerline of each transverse section of the body through which the longitudinal axis extends. Accordingly, the longitudinal axis A-A is not necessarily a straight reference line in all cases depending on the shape and curvature of the toothbrush body.

Body 101 further comprises a head portion 110, a handle portion 120, and a neck portion 121 coupling the handle to head. In certain embodiments, neck portion 121 may a structure that is narrower in width and/or height (measured transversely to longitudinal axis A-A than the head portion 110 and/or handle portion 120.

The front side 112 of the head portion 110 may be substantially planar in one embodiment. The head portion 110 comprises a plurality of tooth cleaning elements 111 extending transversely from the front side 112. The exact types, structure, pattern, orientation and material of the tooth cleaning elements 111 is not limiting of the present invention unless so specified in the claims. As used herein, the term "tooth cleaning elements" is used in a generic sense to refer to any structure or combination of structures that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 of the present invention can be connected to the head portion 110 in any manner now available or to be developed and is also not limiting of the invention. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In certain embodiments, the head portion 110 may also include a soft tissue cleanser (not shown herein) coupled to or positioned on its rear side 113. An example of a suitable soft tissue cleanser that may be used with the present invention and positioned on the rear surface of the head portion 110 is disclosed in U.S. Pat. No. 7,143,462, issued Dec. 5, 2006 to the assignee of the present application, the entirety of which is hereby incorporated by reference. In certain embodiments, the soft tissue cleanser may include a plurality of protuberances, which can take the form of elongated ridges, nubs, or combinations thereof. Of course, the invention is not to be so limited and in certain embodiments the oral care implement 100 may not include any soft tissue cleanser.

In the exemplified embodiment, the head portion 110 is formed integrally with the handle portion 120 and neck portion 121 as a single unitary structure using a molding, milling, machining, and/or other suitable process. However, in other embodiments the handle portion 120, neck portion 121, and head portion 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In certain embodiments, the head and neck portions 110, 121 may be formed as a detachable single unitary structure which is configured for removable coupling to the handle portion 120, thereby allowing the head to be replaceable when the tooth cleaning elements 111 have worn.

With continuing reference to FIGS. 1-9, the handle portion 120 is an axially elongated structure extending from the proximal end 103 of the body 101 to the neck portion 121 that provides a means for grasping and manipulating the toothbrush 100 during use. The handle portion 120 may comprise an ergonomic thumb grip section 122 adjacent neck portion 121 and a finger grip section 123 disposed more proximally. The thumb grip section 122 is located between the neck portion 121 and the finger grip section 123. Handle portion 120 further defines a front surface 124, an opposing rear surface 125, and two opposing lateral side surfaces 126. Surfaces 124-126 collectively form an outer surface 127 of the handle portion 120.

In the exemplified embodiment, the handle portion 120 is generically depicted having various contours for user comfort. More specifically, in the exemplified embodiment the thumb grip section 122 of the handle portion 120 is a more bulbous diametrically enlarged structure relative to the outer surface 127 of and other portions of the handle portion 120. Thus, thumb grip section 122 may have a diameter and width measured transversely to longitudinal axis A-A between lateral sides 126 of the handle portion 120 that is greater than a width of the finger grip section 123 of the handle portion. Of course, the invention is not to be so limited in all embodiments, and in certain other embodiments the thumb grip section 122 may not have a greater width than the entire or at least portions of the finger grip section 123. For example, the proximal portion of the finger grip section 123 may be bulbous shaped and wider than other portions of the finger grip section in addition to or instead of the thumb grip section 122. The handle portion 120 can therefore take on a wide variety of shapes, contours and configurations, none of which are limiting of the present invention unless so specified in the claims.

In the exemplified embodiment, the handle portion 120 of toothbrush 100 which may be made of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle portion 120 may be formed with a semi-rigid material. Handle portion 120 may further include surface portions (e.g. grip-enhancement member 136 as further described herein) which are formed of a non-slip resilient material for greater comfort and handling, such as without limitation a thermoplastic elastomer (TPE) affixed over portions of or the entirety of the handle portion 120 to enhance grip of the toothbrush during use. For example, parts of the handle portion 120 that are typically gripped by a user's palm, fingers, and/or thumb during use, such as the finger grip section 123 and thumb grip section 122, may be partially or totally overmolded with a thermoplastic elastomer or other resilient material to further increase comfort and grip for a user.

According to one aspect of the invention, a grip control component 130 may be disposed on the handle portion 120 in the thumb grip section 122. Grip control component forms a control section of a handle 120*a* defined by the handle portion 120 for articulating the toothbrush 100. In one embodiment, grip control component 130 may be disposed primarily on the front and adjoining upper lateral side surfaces 124, 126 of the handle portion 120 on the front surface 124 of the handle portion 120. The component 130 advantageously is configured to engage the user's thumb and produce the proper brushing angle of the toothbrush head portion 110 and tooth cleaning elements 111 for cleansing the interface between the gums and teeth when the user grasps the toothbrush 100.

Figure 10:
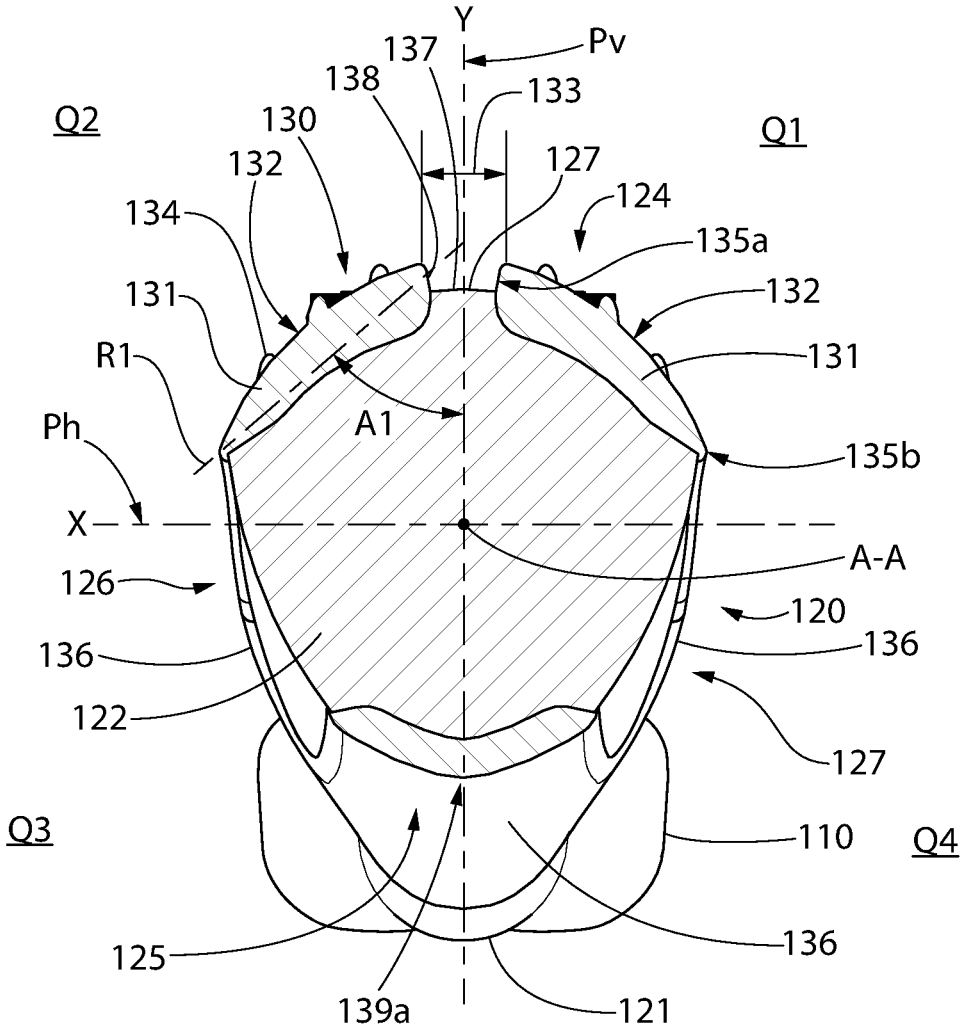
FIG. 10 is a transverse cross-sectional view thereof taken along line X-X in FIG. 3.

Referring to the cross section of FIG. 10 which looks towards toothbrush head portion 110, a reference orthogonal X-Y coordinate system is identified with respect to thumb grip section 122 to facilitate description of the grip control component 130. The Y-axis defines a vertical centerline and a vertical reference plane Pv that includes the longitudinal axis A-A and is orthogonal to the front surface 124 of head portion 110 of the toothbrush 100. The X-axis defines a horizontal centerline and a horizontal reference plane Ph which includes the longitudinal axis A-A and is orthogonal to the lateral sides 114 of head portion 110 of the toothbrush 100. The vertical and horizontal planes Pv and Ph accordingly intersect at the longitudinal axis A-A of the toothbrush 100. Rotating the thumb grip section 122 transversely to and about the longitudinal axis A-A concomitantly rotates the head portion 110 in unison therewith. The X-Y coordinate system defines upper right and left quadrants Q1, Q2 and lower left and right quadrants Q3, Q4. In the non-limiting embodiment illustrated in FIG. 10, the thumb grip section 122 may have an asymmetrical cross-sectional shape with respect to the X and/or Y axes.

Referring now to FIGS. 1-10 (with particularity to FIG. 10), grip control component 130 includes a pair of longitudinally elongated and transversely/laterally spaced apart raised grip elements 131 each defining a control surface 132 thereon positioned for engaging a user's thumb when grasping the handle portion 120 of toothbrush 100. Each grip element 131 has an axial length sufficient to accommodate a portion of the user's thumb. In the illustrated non-limiting embodiment, control surfaces 132 may each have an arcuate and outwardly convex curvature to maximize user comfort when engaging the grip elements 131 with the thumb. In other possible embodiments, however, control surfaces 132 may be substantially planar.

The grip elements 131 and hence control surfaces 132 thereof are separated by an axially elongated longitudinally extending channel 133. In one implementation, an exposed portion of the outer surface 127 of the handle portion 120 forms a bottom wall or floor 137 of the channel 133 and the grip elements 131 form opposing upstanding walls 138 of the channel which project vertically from the front surface 124 of the handle portion 120 (see, e.g. FIG. 10). In one non-limiting embodiment, channel 133 may be oriented substantially parallel to longitudinal axis A-A (best shown in FIG. 3) such that the channel is axially aligned with and extends along vertical reference plane Pv. Channel 133 is disposed on the same front side 112 and front surface 124 of the handle portion 120 of the toothbrush body 101 as tooth cleaning elements 111 of the head portion 110.

Figure 3:
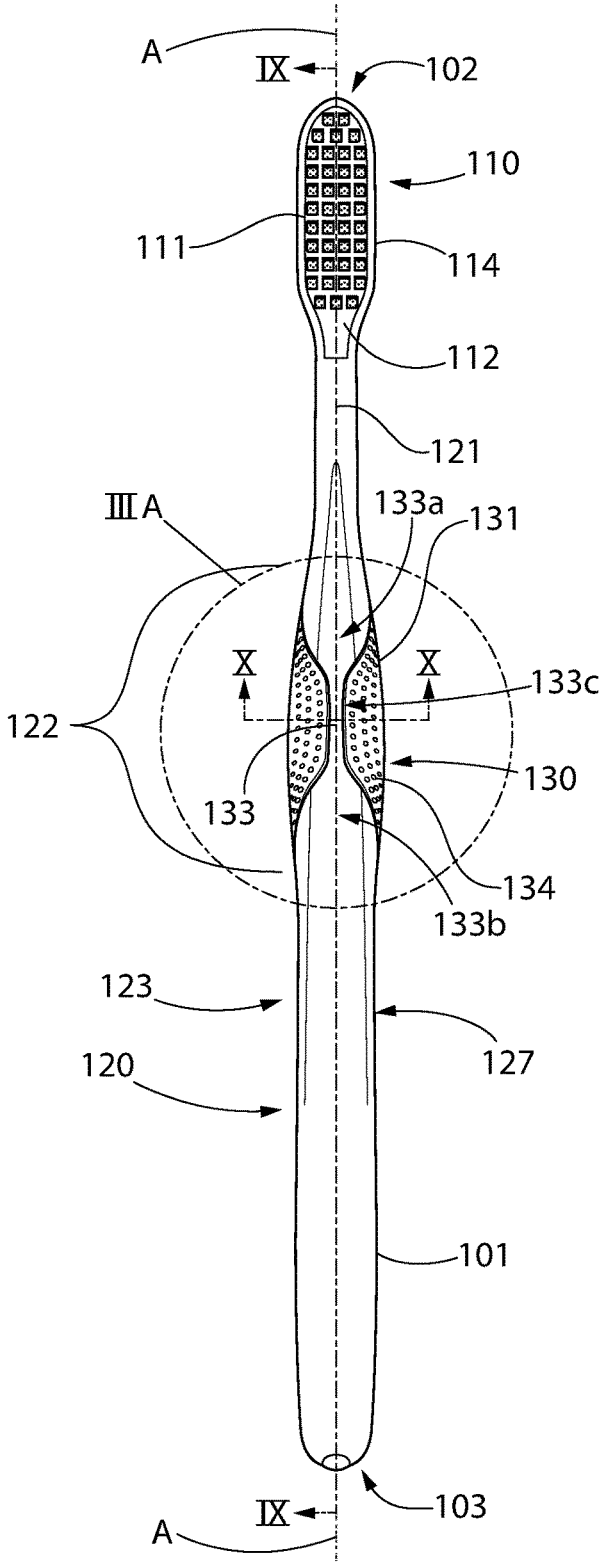
FIG. 3 is a front view thereof.
Figure 3A:
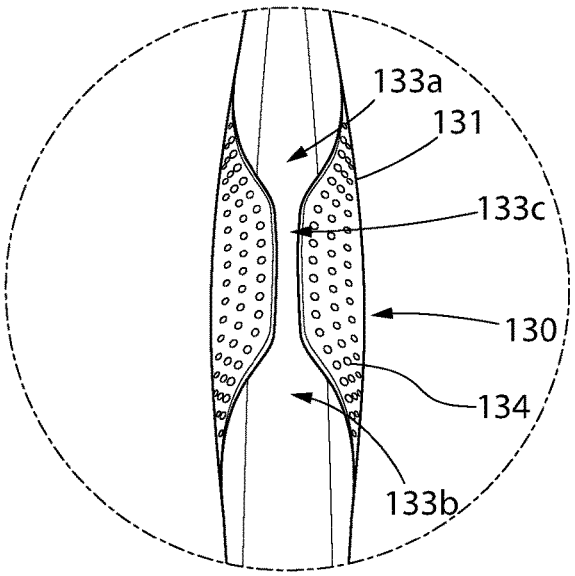
FIG. 3A is a close-up of area IIIA of FIG. 3.
Figure 4:
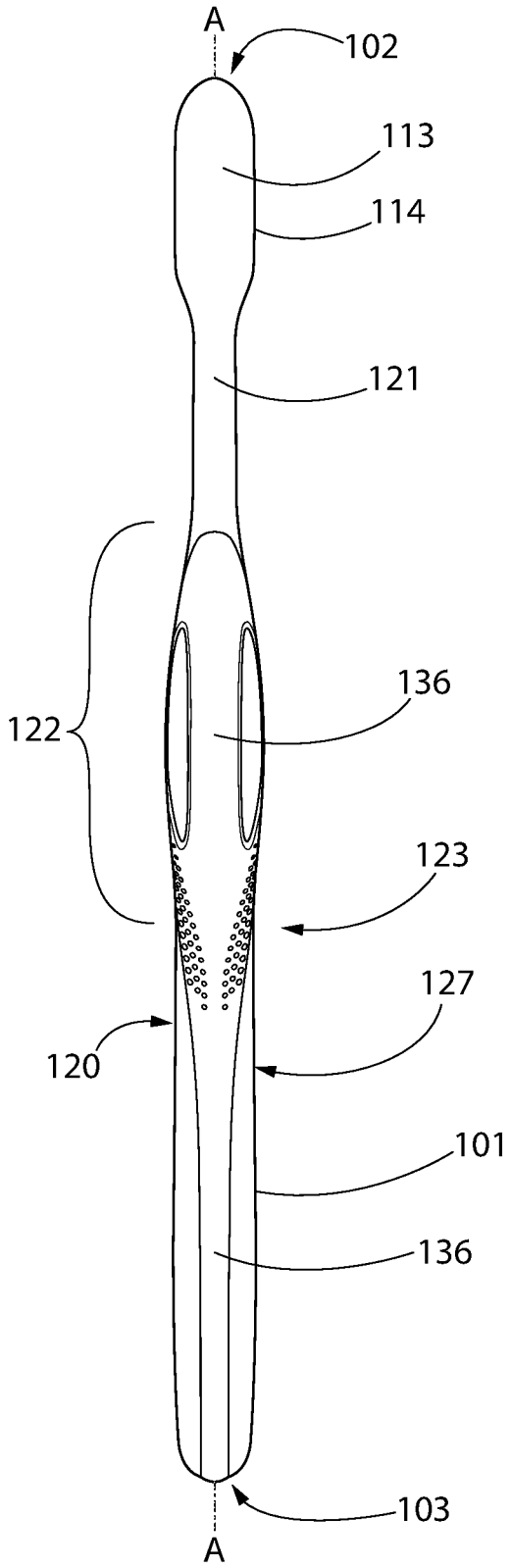
FIG. 4 is a rear view thereof.
Figure 5:
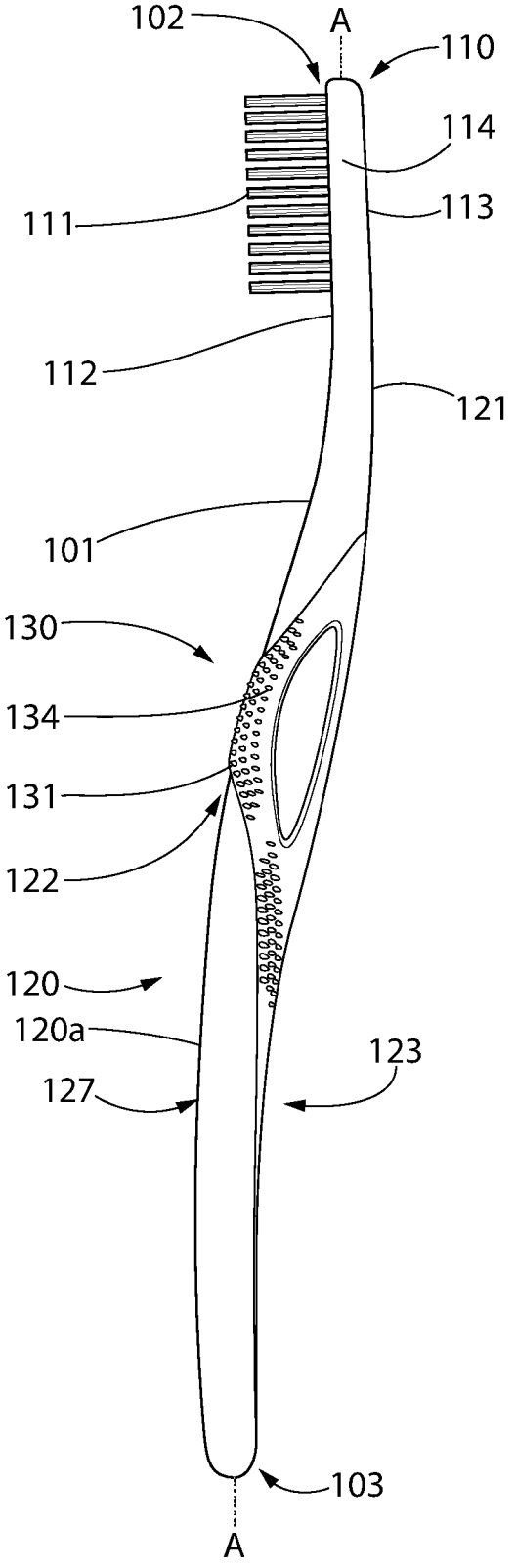
FIG. 5 is a right side view thereof.
Figure 6:
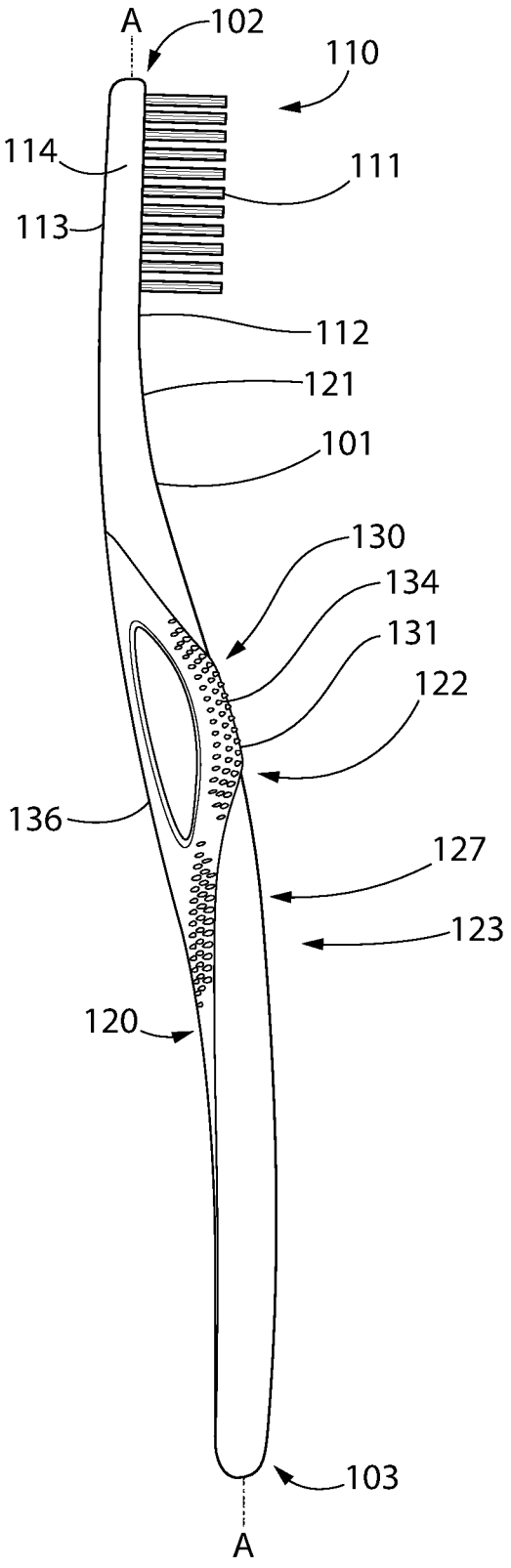
FIG. 6 is a left side view thereof.
Figure 7:
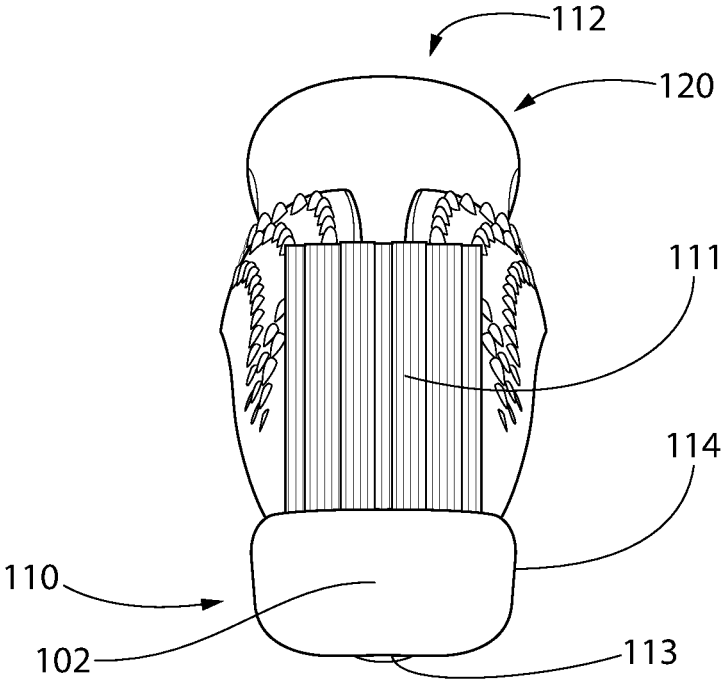
FIG. 7 is a distal end view thereof.
Figure 8:
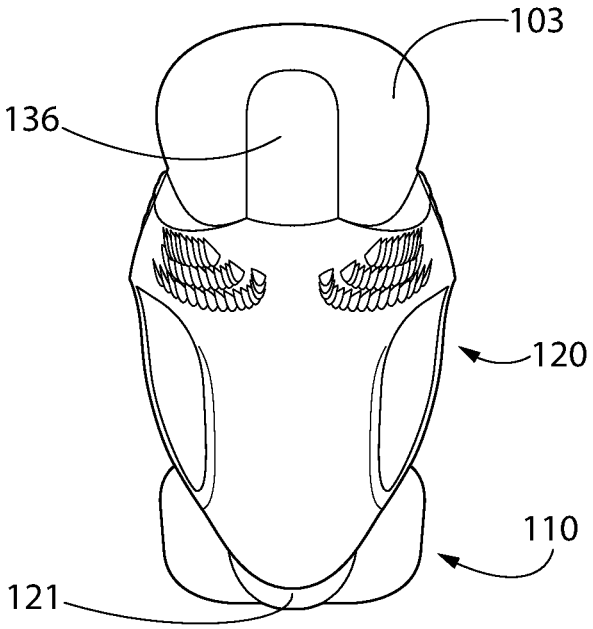
FIG. 8 is a proximal end view thereof.
Figure 9:
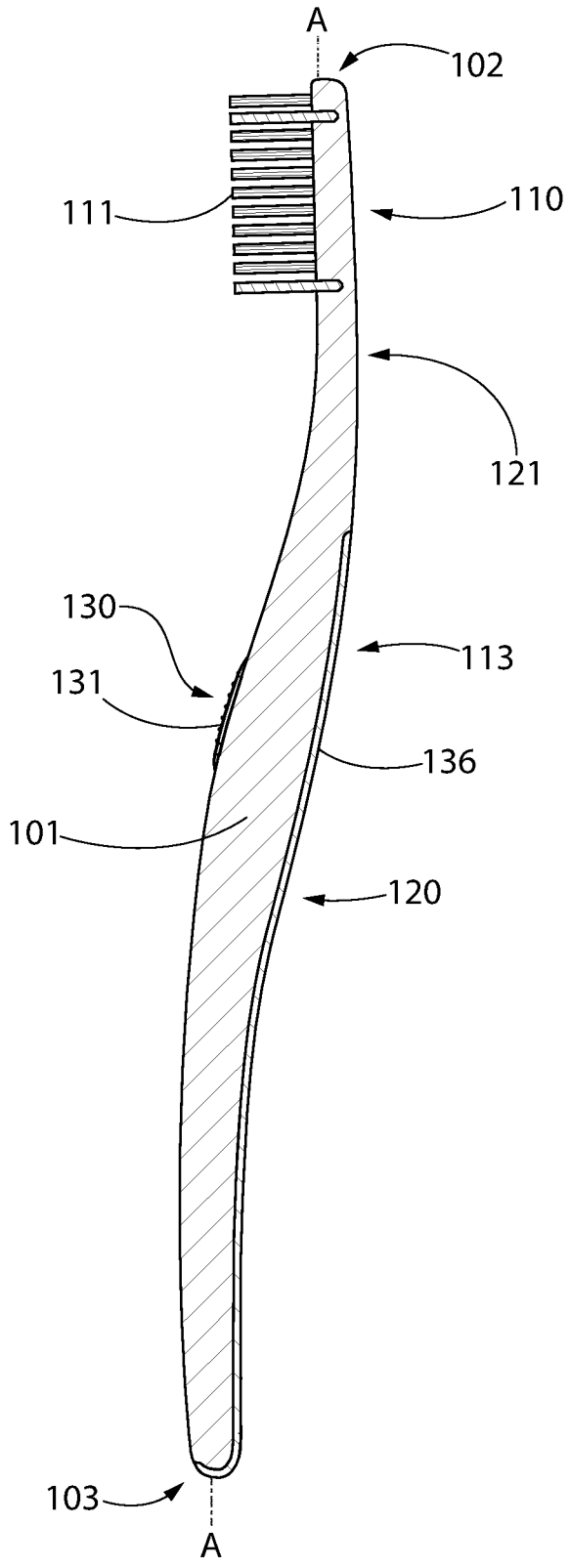
FIG. 9 is a longitudinal cross-sectional view thereof.

In one non-limiting embodiment, the channel 133 may have a shape approximating an hour glass shape in front plan view (best shown in FIGS. 3 and 3*a*) comprising a first distal channel end section 133*a*, a second proximal channel end section 133*b*, and a narrowed waist channel section 133*c* located between the end sections. Waist channel section 133*c* therefore may have a smaller lateral width than the proximal-most and distal-most portions of the two end sections 133*a*, 133*b*. The end sections 133*a*, 133*b* each have a width that increases with distance from the narrowed waist channel section 133*c* in a direction towards the distal end 102 and proximal end 103 of the toothbrush 100, respectively. This shape of the channel 133 guides a user to grasp the handle portion 120 of toothbrush 100 near the axial central region of the handle for optimum balance and comfort. Other shapes of channels however may be used.

The grip elements 131 may be formed of any suitable material. In one implementation, the grip elements 131 may be formed of a resilient material such as TPE affixed over a portion of the thumb grip section 122 by any manner such as overmolding, adhesives, etc. The resilient elements 131 may be separate discrete features of the handle portion 120, or in some configurations elements 131 may be formed as an integral structural and contiguous portion of a relatively larger resilient grip-enhancement member 136 overmolded or otherwise affixed to the handle portion as disclosed herein. In the embodiment shown herein, the grip elements 131 are interconnected on the rear surface 125 of the handle portion 120 by portions of the grip-enhancement member 136 disposed on the thumb grip section 122 and finger grip section 123. The grip-enhancement member 136 overlies a rear portion of the outer rear surface 125 of the handle portion 120; the grip control component being an integrally formed monolithic component therewith.

In one configuration, the grip-enhancement member 136 extends axially from bottom end 103 of the toothbrush 100 to neck portion 121. The grip-enhancement member 136 may extend circumferentially from the rear surface 125 and along each lateral side surface 126 of the handle portion 120 and connect to each grip element 131. In the non-limiting embodiment illustrated herein, the grip-enhancement member 136 may be substantially flush with the outer surface 127 of the handle portion whereas the grip elements 131 may have a raised structure relative to the outer surface. The grip-enhancement member 136 therefore may follow and complement the contours and shape of the outer surface 127 of the toothbrush handle portion 120. In other embodiments, grip-enhancement member 136 may be slightly raised with respect to the outer surface 127 of the handle portion 120. Grip-enhancement member 136 may affixed to handle portion 120 of the toothbrush body 101 by any suitable method such as overmolding, adhesives, etc.

Yet in other implementations, the grip elements 131 may be formed by raised non-resilient protrusions on the outer surface 127 of the handle portion 120 separate from resilient grip enhancement elements of the handle portion. The term "resilient" as used herein shall mean a material which is partially deformable under finger or thumb pressure and has an elastic memory that returns the material to an original configuration when the pressure is released.

In one implementation referring to FIG. 10, the handle portion 120 may further comprise a vertically elongated apex 139 on the rear surface 125 of the handle which is aligned with and extends along the vertical reference plane Pv. Apex 139 may form a cross-sectional shape of the thumb grip section 122 (control section) of the toothbrush handle portion 120 in which the lateral width of the thumb grip section 122 below the horizontal reference plane Ph is smaller than the lateral width of the thumb grip section 122 above the horizontal reference plane Ph.

The control surfaces 132 of the grip control component 130 may include a plurality of raised tactile engagement elements such as protuberances 134 protruding outwards from the surfaces. The protuberances 134 are positioned and arranged to enhance engagement with the user's thumb (see, e.g. FIGS. 11A and 11B). In the exemplary embodiment, the protuberances 134 are in the shape of slightly rounded columnar nubs protruding outwards from each of the control surfaces 132 of the raised grip elements 131. However, the invention is not limited to this configuration of elements 134 and the protuberances can take other forms such as without limitation elongated ridges, chevrons, or other raised surface structures which enhance tactile engagement. Furthermore, the exact number, size, shape, and arrangement of the protuberances 134 is not limiting of the present invention. In still other embodiments, the protuberances 134 can be omitted altogether and the outer surfaces 131 of the grip component 130 may be relatively smooth and free of protuberances.

Referring to FIG. 10, one grip element 131 each is disposed in upper right and left quadrants Q1 and Q2. In one non-limiting embodiment, the grip elements 131 are confined to quadrants Q1 and Q2 and do not extend into the lower quadrants Q3, Q4 of the bottom half of the thumb grip section 122 below the X-axis. Placement of the grip elements 131 in this manner is sufficient to produce the proper brushing angle when the grip control component 130 is grasped by the user, thereby advantageously allowing the other lower half and bottom outer surfaces 127 of the thumb grip section 122 to smoothly transition into and match the contours handle portion 120 without abrupt angles to maximize tactile comfort. In certain other possible embodiments, however, each of the grip elements 131 may extend down to the X-axis or below into the lower quadrants Q3, Q4.

Each grip element 131 defines a first inner edge 135*a* adjacent channel 133 and proximate to the vertical centerline axis (Y-axis), and a second outer edge 135*b* located more distally from the vertical centerline and more proximate to the horizontal centerline axis (X-axis). A straight reference line R1 drawn through the middle of each inner and outer edge 135*a*, 135*b* intersects the vertical centerline at an oblique angle A1. In some embodiments, angle A1 may be between 0-90 degrees, and more particularly from about and including 30-60 degrees. Accordingly, the grip elements 131 are each oriented at oblique angle to the vertical centerline and arranged to form a generally V-shaped pattern or arrangement with the inner edge 135*a* converging towards the vertical centerline as best shown in FIG. 10.

Figure 11A:
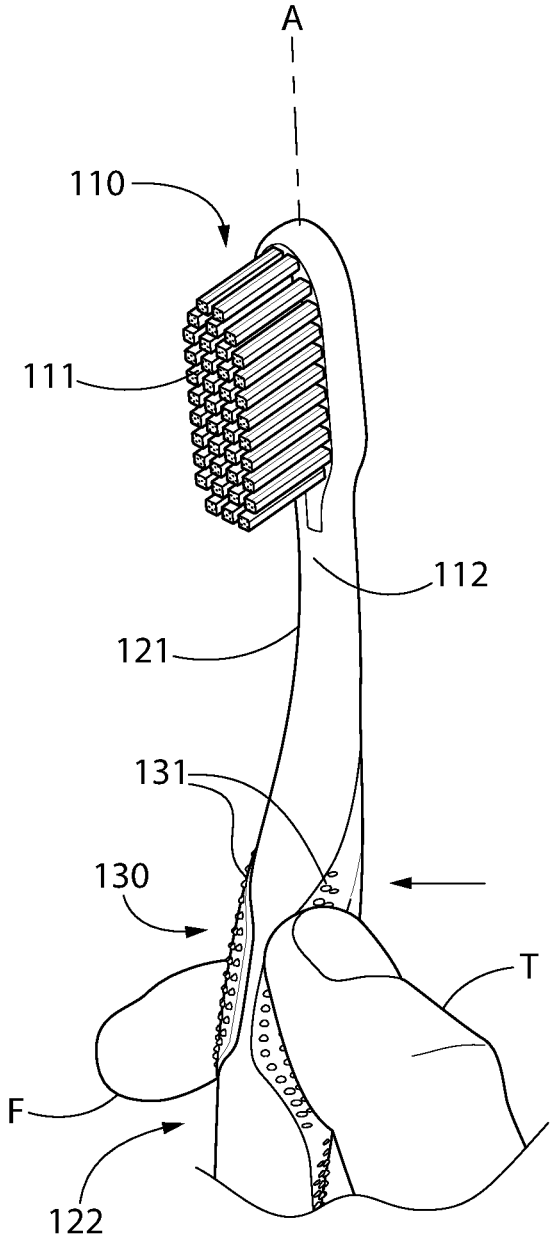
FIG. 11A is a front perspective view of a first operating mode of the oral care implement of FIG. 1.
Figure 11B:
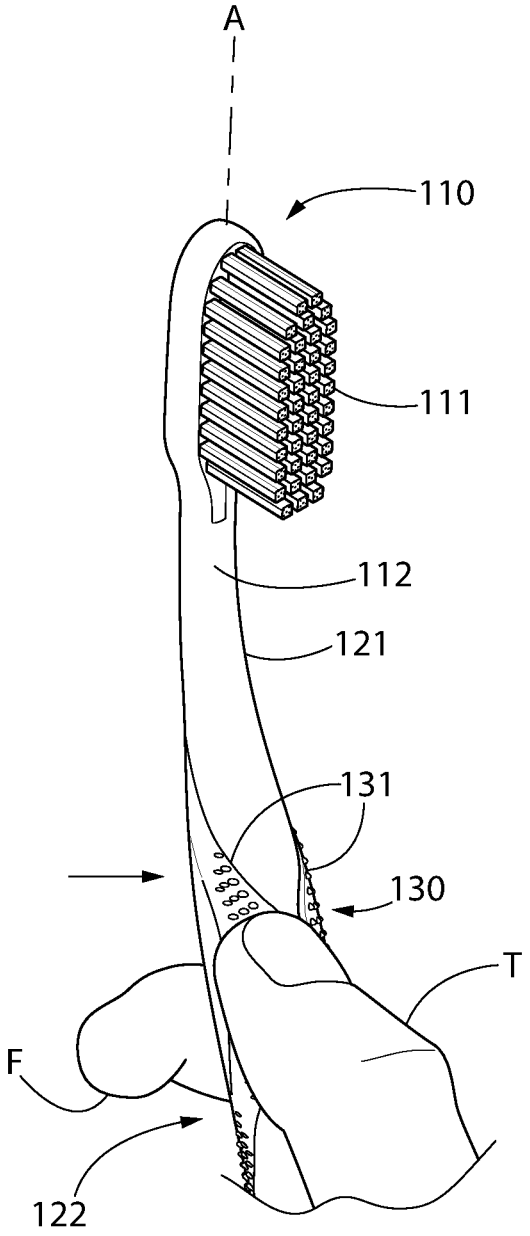
FIG. 11B is a front perspective view of a second operating mode of the oral care implement of FIG. 1.

In operation, the raised structure of the grip elements 131 and control surfaces 132 thereon function in combination with the channel 133 to approximate the proper 45 degree brushing angle of the toothbrush head portion 110 and tooth cleaning elements 111 when the user grasps the elements between the thumb T and forefinger F as shown in FIGS. 11A and 11B. The thumb T engages one or the other of the grip elements 131 and the forefinger F engages the rear surface 125 of the toothbrush handle portion 120. The channel 133 naturally causes the user's thumb T to physically gravitate onto one or the other of the grip elements 131 because ergonomically it is more comfortable to rest the thumb on either element than across or in the channel. The raised grip elements 131 on the left and right side can help to better adjust the brushing angle when brushing teeth. Placing the thumb T on the right element 131 shown in FIG. 11A ("right" defined when viewed from the front surface 124 of the handle portion 120) causes the toothbrush 100 and head portion 110 to rotate or tilt in an opposite direction towards the left (see directional arrow). Conversely, placing the thumb T on the right element 131 shown in FIG. 11B ("left" being defined when viewed from the front surface 124 of the handle portion 120) causes the toothbrush 100 and head portion 110 to rotate or tilt in an opposite direction towards the right (see directional arrow). Accordingly, the grip elements 131 operate to tilt the head portion at an upward or downward angle in the foregoing two operating modes relative to a vertical plane defined a user's teeth when one of the grip elements is grasped between the user's thumb and forefinger.

In one embodiment shown in FIGS. 1-10, the body 101 of toothbrush 100 may have a solid one-piece construction (see, e.g. FIG. 10). Body 101 therefore forms a solid structure which may be transparent, translucent, or opaque and have various colors. In a second embodiment shown in FIGS. 12 and 13, body 101 of an aesthetically different toothbrush handle may have a dual component composite construction comprising a longitudinally extending inner core 140 disposed inside the body 101 of the toothbrush 100. The body 101 in such a composite construction may be formed of a clear transparent or translucent material whereas the inner core 140 is made of a colored transparent, translucent, or opaque material. In one implementation, the inner core 140 may extend from the proximal end 103 of the toothbrush handle portion 120 to the neck portion 121 of the toothbrush. The inner core 140 may be centered in the body 101 and generally follow the longitudinal axis A-A as illustrated herein or offset from the center in other embodiments. The inner core 140 may be made for example without limitation by a sandwich injection process or other suitable process. Inner core 140 may be made of any suitable material, preferably a polymeric material in certain non-limiting embodiments.

Figure 12:
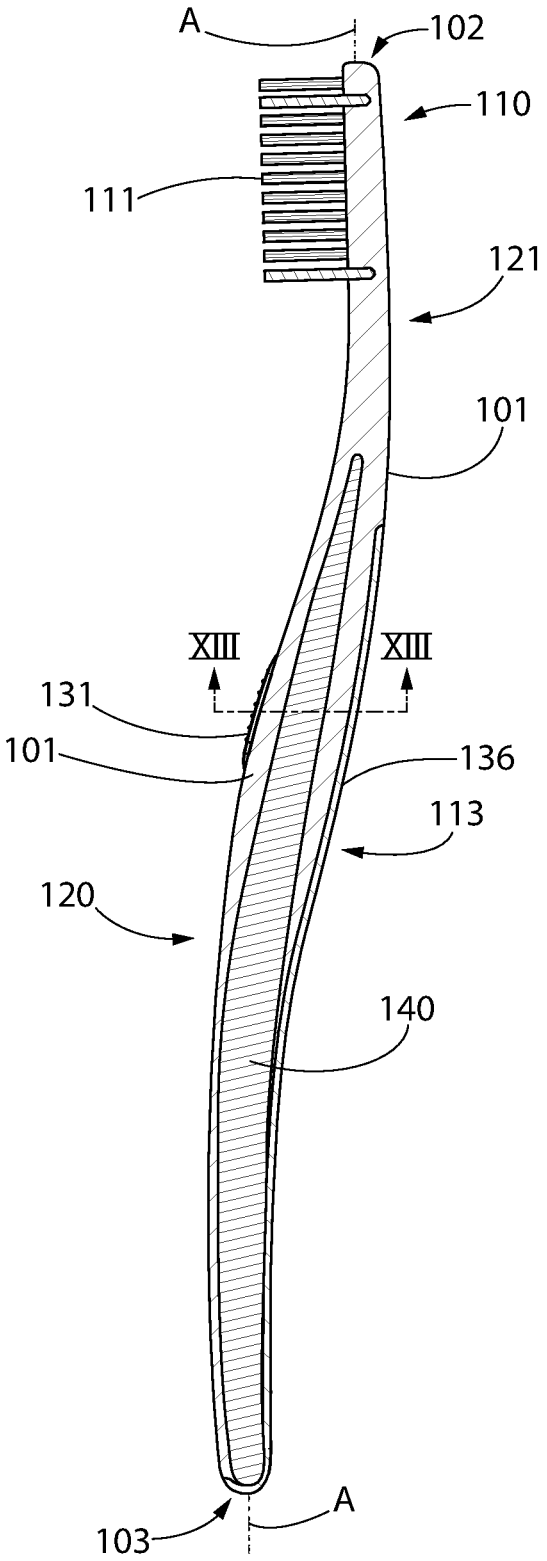
FIG. 12 is a longitudinal cross-sectional view of an alternative construction of the oral care implement of FIG. 1.
Figure 13:
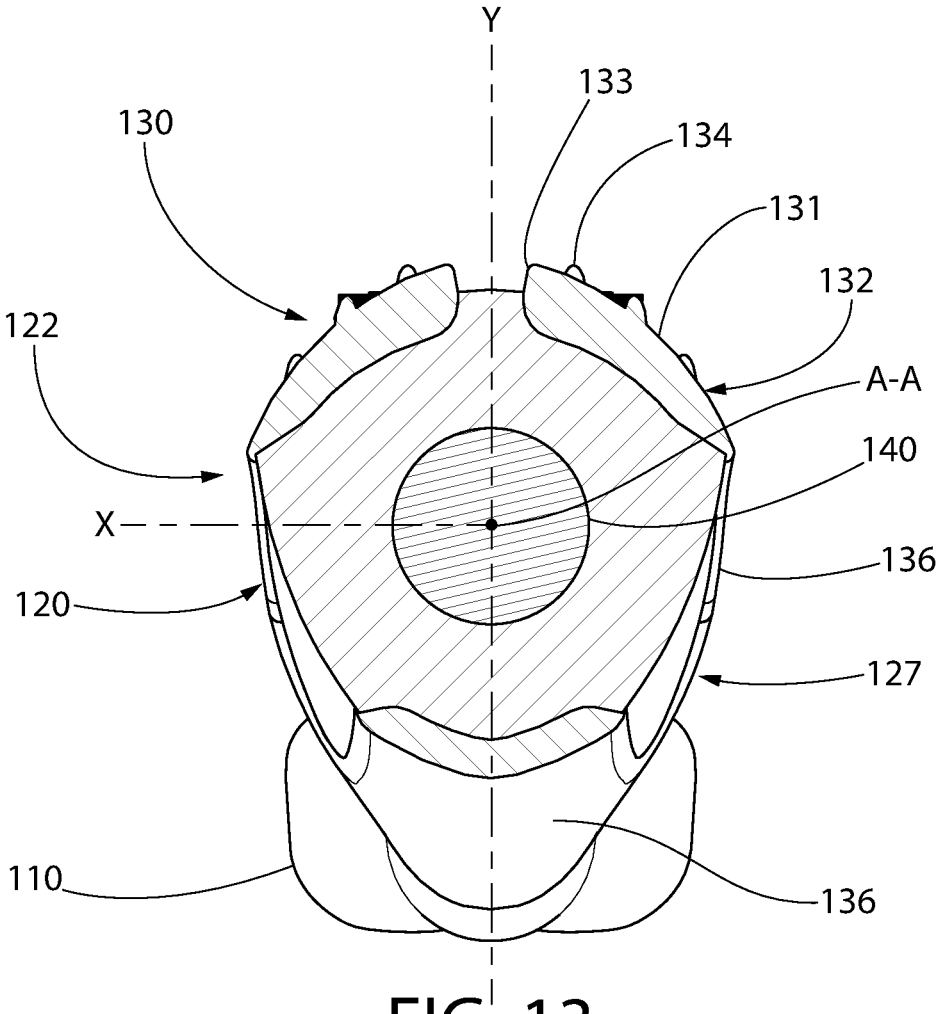
FIG. 13 is a transverse cross-sectional view thereof taken along line XIII-XIII in FIG. 12.

With continuing reference to FIGS. 12 and 13, the inner core 140 is visible through the clear transparent/translucent body 101 of the toothbrush 100 and may be provided in a variety of single colors or multiple colors with or without aesthetic patterns (e.g. stripes, geometric patterns, etc.). In yet other variations, the body 101 may be made of a colored transparent/translucent material such that the inner core 140 preferably having a different color than the body remains visible. The inner core 140 may further include alphanumerical indicia in some embodiments. Accordingly, it will be appreciated that numerous variations of a composite toothbrush body 101 are possible and not limited to the examples provided above.

In one embodiment, the inner core 140 may be completely embedded inside the body 101 as shown herein. In certain other configurations, the inner core 140 may be partially embedded inside the body such that one or more portions of the inner core 140 are exposed on the outer surface 127 of the toothbrush.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

an elongated body extending along a longitudinal axis and comprising a head portion and a handle portion having an outer surface;

a plurality of tooth cleaning elements extending from a front surface of the head portion of the elongated body; and a grip-enhancement member comprising a grip control component disposed on the handle portion of the elongated body to form a control section of the handle of the oral care implement, the grip control component comprising:

a first grip element comprising a first upstanding wall and a first control surface extending from the first upstanding wall;

a second grip element comprising a second upstanding wall and a second control surface extending from the second upstanding wall; and the first and second grip elements transversely spaced apart from one another and separated by a longitudinally extending channel, the longitudinally extending channel defined by a floor and the first and second upstanding walls, the floor being formed by an exposed portion of the handle portion of the elongated body that is located between the first and second upstanding walls;

wherein the control section is located adjacent a neck of the oral care implement and is diametrically enlarged relative to a finger gripping section of the handle, the finger gripping section extending from a proximal end of the oral care implement to the control section; and wherein the grip-enhancement member comprises a finger grip control portion along the finger gripping section of the handle, the finger grip control portion comprising a base portion extending along a rear surface of the elongated body, a first set of protuberances protruding from the base portion on a first side of the longitudinal axis of the elongated body and configured for engagement with a finger of a user's right hand when the oral care implement is gripped by the user's right hand, and a second set of protuberances protruding from the base component on a second side of the longitudinal axis of the elongated body and configured for engagement with a finger of a user's left hand when the oral care implement is gripped by the user's left hand.

2. The oral care implement according to claim 1 wherein the first and second sets of protuberances are arranged in a V-shape such that the protuberances of the first and second sets of protuberances are located a greater distance from the longitudinal axis with increasing distance from the proximal end of the oral care implement.

3. The oral care implement according to claim 1, wherein the elongated body is formed of a hard plastic and the grip-enhancement member is formed of a resilient material that overlies the elongated body.

4. The oral care implement according to claim 1, wherein the first and second control surfaces are located on opposite sides of a first reference plane that includes the longitudinal axis and is orthogonal to the front surface of the head portion, wherein the first reference plane intersects the longitudinally extending channel, and wherein the longitudinally extending channel is aligned with and extends along the first reference plane.

5. The oral care implement according to claim 1 wherein the first and second grip elements have concave upper edges facing a distal end of the handle and concave lower edges facing a proximal end of the handle.

6. The oral care implement according to claim 5, wherein the longitudinally extending channel has a first channel section, a second channel section, and a narrowed waist section, the first channel section being located between the concave upper edges of the first and second grip elements, the second channel section being located between the concave lower edges of the first and second grip elements, and the narrowed waist section being located between the first and second channel sections and between the first and second upstanding walls.

7. The oral care implement according to claim 6, wherein each of the first and second channel sections has a width that increases with increasing distance from the narrowed waist section.

8. The oral care implement according to claim 1, wherein each of the first and second control surfaces includes a plurality of protuberances extending therefrom.

9. The oral care implement according to claim 8, wherein the plurality of protuberances are nubs having a maximum diameter, wherein the longitudinally extending channel has a minimum width measured between the first and second upstanding walls, the minimum width of the longitudinally extending channel being greater than the maximum diameter of the nubs.

10. The oral care implement according to claim 1, wherein the control section of the handle comprises a transverse cross-sectional profile comprising a first quadrant, a second quadrant adjacent the first quadrant, a third quadrant adjacent the second quadrant, and a fourth quadrant adjacent the third and first quadrants; wherein the first control surface is confined to the first quadrant and the second control surface is confined to the second quadrant; wherein the transverse cross-sectional profile comprises an apex at the intersection of the fourth and third quadrants; and wherein the longitudinally extending channel is located in both of the first and second quadrants.

11. An oral care implement comprising:

a body portion formed of a rigid material that extends along a longitudinal axis, the body portion comprising a thumb grip section and a finger grip section;

a monolithic mass of resilient material coupled to the body portion, the monolithic mass of resilient material comprising:

a thumb grip control portion located along the thumb grip section of the body portion, the thumb control portion comprising:

a first grip element comprising a first upstanding wall that protrudes from the body portion, the first upstanding wall facing the longitudinal axis of the body portion and located on a first side of the longitudinal axis of the body portion;

a second grip element comprising a second upstanding wall that protrudes from the body portion, the second upstanding wall facing the longitudinal axis of the body portion and located on a second side of the longitudinal axis of the body portion so that an exposed portion of the body portion extends between the first and second upstanding walls; and a longitudinally extending channel defined by the exposed portion of the body portion and the first and second upstanding walls.

12. The oral care implement according to claim 11 wherein the first grip element comprises a first control surface and the second grip element comprises a second control surface, the first control surface intersecting the first upstanding wall at a first control edge that is elevated relative to the exposed portion of the body portion, and the second control surface intersecting the second upstanding wall at a second control edge that is elevated relative to the exposed portion of the body portion.

13. The oral care implement according to claim 12 further comprising a plurality of protuberances extending from the first and second control surfaces of the first and second grip elements.

14. The oral care implement according to claim 13 wherein the plurality of protuberances are nubs having a maximum diameter and wherein the longitudinally extending channel has a minimum width measured between the first and second upstanding walls, the minimum width of the longitudinally extending channel being greater than the maximum diameter of the nubs.

15. The oral care implement according to claim 11 wherein the body portion comprises a handle portion and a head portion, and further comprising a plurality of tooth cleaning elements extending from a front surface of the head portion.

16. The oral care implement according to claim 11 wherein the monolithic mass of resilient material comprises a finger grip control portion located along the finger grip section of the body portion, the finger grip control portion comprising a base portion having an outer surface that is flush with an outer surface of the body portion, a first set of protuberances protruding from the base portion on a first side of the longitudinal axis of the elongated body and configured for engagement with a finger of a user's right hand when the oral care implement is gripped by the user's right hand, and a second set of protuberances protruding from the base component on a second side of the longitudinal axis of the elongated body and configured for engagement with a finger of a user's left hand when the oral care implement is gripped by the user's left hand.

17. The oral care implement according to claim 16 wherein the first and second sets of protuberances are arranged in a V-shape such that the further the protuberances of the first and second sets are located from a proximal end of the body portion, the greater the distance from the protuberances of the first and second sets to the longitudinal axis.

18. An oral care implement comprising:

an elongated body extending along a longitudinal axis, the elongated body including a head portion and a handle portion comprising an outer surface, the elongated body formed of a rigid material;

a plurality of tooth cleaning elements extending from a front surface of the head portion;

first and second grip elements on the handle portion of the elongated body to form a control section of a handle of the oral care implement, the first and second grip elements transversely spaced apart from one another;

each of the first and second grip elements formed of a resilient material and protruding from the outer surface of the elongated body to form a longitudinally extending channel therebetween, the longitudinally extending channel defined by:

a first upstanding wall formed by a side surface of the first grip element;

a second upstanding wall formed by a side surface of the second grip element; and a floor formed by a portion of the outer surface of the handle portion that extends between the first and second upstanding walls;

wherein the first and second grip elements have concave upper edges facing a distal end of the handle and concave lower edges facing a proximal end of the handle.

* * * * *